United States Patent [19]

Black et al.

[11] 4,159,583

[45] Jul. 3, 1979

[54] ELEVATING SCRAPER UP-STOP MECHANISM

[75] Inventors: William J. Black, Wilmington; Warner G. Richardson; Eugene M. Wilson, both of Joliet, all of Ill.

[73] Assignee: Caterpillar Tractor Co., Peoria, Ill.

[21] Appl. No.: 816,831

[22] Filed: Jul. 18, 1977

[51] Int. Cl.[2] ..... E02F 1/36

[52] U.S. Cl. ..... 37/8

[58] Field of Search ..... 37/8, 126 R, 129

[56] References Cited

U.S. PATENT DOCUMENTS

| | | | |
|---|---|---|---|
| 3,048,934 | 8/1962 | Hancock | 37/8 |
| 3,210,868 | 9/1965 | Liess | 37/8 |
| 3,381,396 | 5/1968 | Klein | 37/8 |
| 3,423,853 | 1/1969 | Eftefield et al. | 37/8 |
| 3,427,641 | 2/1969 | Duke | 37/8 |
| 3,431,660 | 3/1969 | Keith et al. | 37/8 |
| 3,466,764 | 9/1969 | Smith | 37/8 |
| 3,474,548 | 10/1969 | Miller | 37/8 |
| 3,479,754 | 11/1969 | Duke et al. | 37/8 |
| 3,492,745 | 2/1970 | Buckstead | 37/8 |
| 3,735,509 | 5/1973 | Condra | 37/8 |
| 3,900,977 | 8/1975 | Hyler | 37/8 |
| 3,916,541 | 11/1975 | Hood et al. | 37/8 |

*Primary Examiner*—E. H. Eickholt

*Attorney, Agent, or Firm*—Wegner, Stellman, McCord, Wiles & Wood

[57] ABSTRACT

In a self-loading scraper, an elevator is provided with a linkage assembly for upward movement of the elevator about an axis offset from the center of the elevator. Movable stops carried by the elevator engage with spaced, fixed stops carried by the scraper bowl so as to limit the upward and downward movement of the elevator relative to the cutter blade on the bowl.

3 Claims, 9 Drawing Figures

FIG. 3
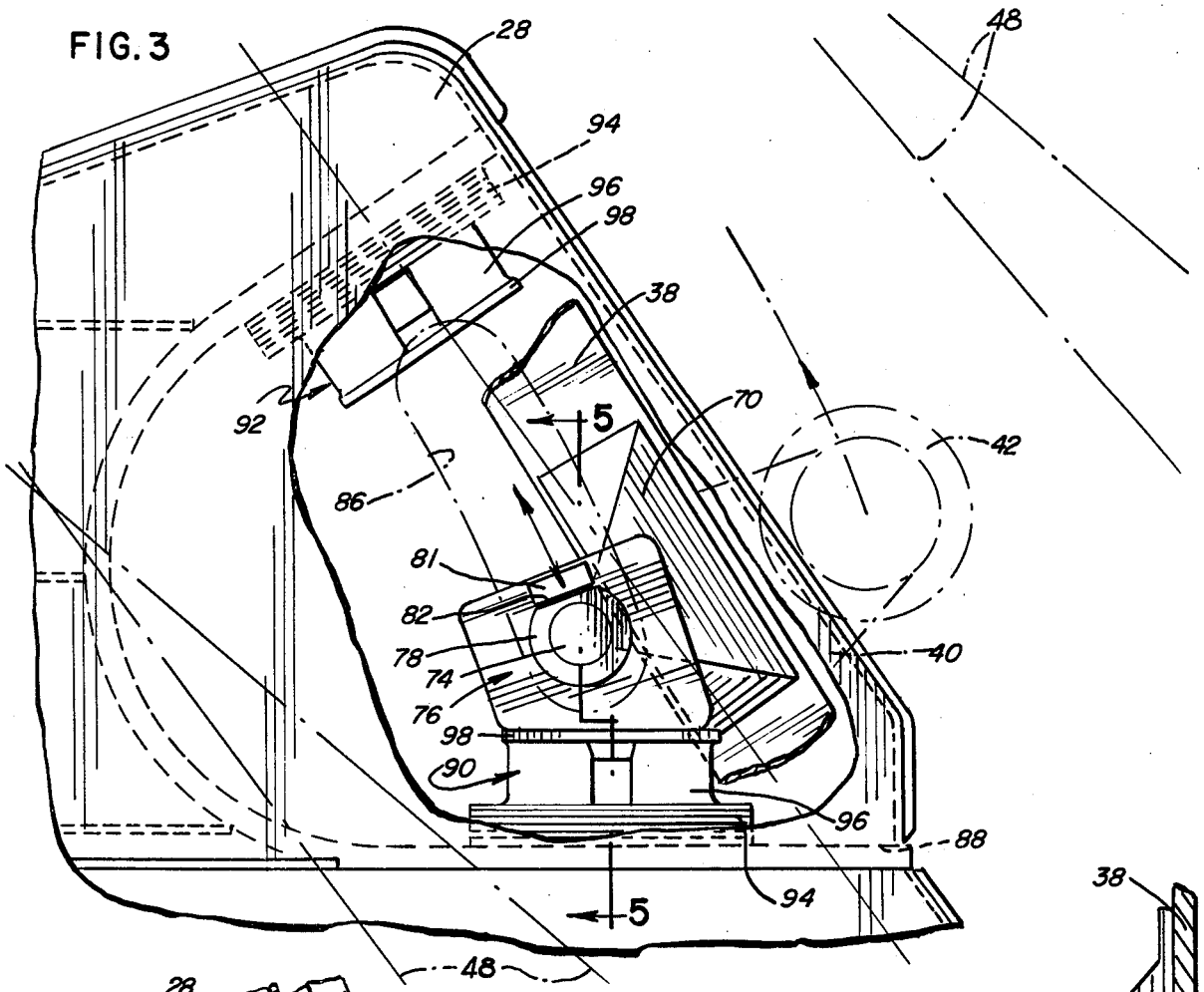
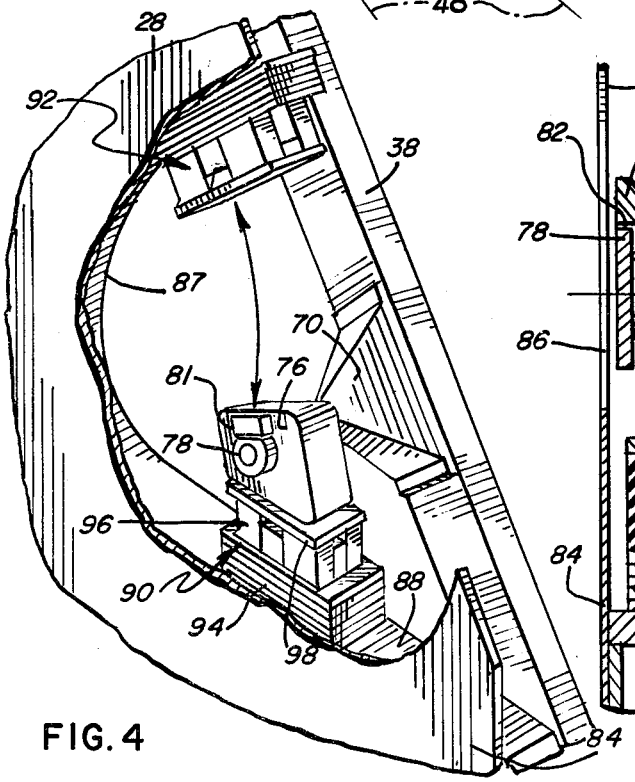
FIG. 4
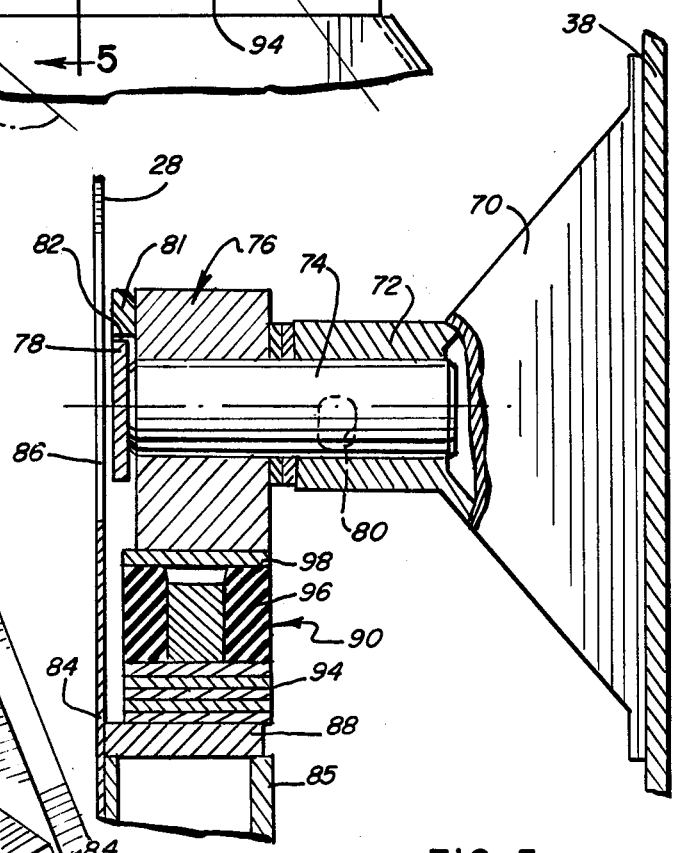
FIG. 5

ELEVATING SCRAPER UP-STOP MECHANISM

BACKGROUND OF THE INVENTION

1. FIELD OF THE INVENTION

This invention relates to an elevator mechanism for a tractor-scraper vehicle and, more particularly to an apparatus for limiting upward and downward movement of said elevator.

2. DESCRIPTION OF THE PRIOR ART

Tractor drawn scrapers have soil-cutting blades at the forward edge of the bowl, which bowl is provided with a continuous chain conveyor extending upwardly from the blade and forming the forward wall of the bowl. The elevator is driven to lift soil from the region of the blade, thereby reducing the resistance which the load offers to the movement of soil into the bowl. In some instances, the use of the elevator mechanism eliminates the need for a separate pusher tractor aiding the scraper in order to load the bowl.

It has been found that if the elevator is rigidly mounted on the scraper bowl, frequent stalling and damage occurs due to the elevator engaging relatively immovable objects, such as a large boulder or a rock which is too large to be elevated by the elevator into the bowl. To eliminate this problem, elevators have been mounted on a floating mount in such a way that the elevator can be pushed up to override large boulders or stones, or other obstructions, and can reposition itself when the obstruction is past.

One such floating mount is interconnected with a pivotal floor portion such that when the floor portion is pivoted to drop the load, the elevator is moved forward and upward to clear a large opening for dropping the load. Other types of linkage arrangements are also available whereby the elevator is moved forward and upward either to avoid obstructions in the loading operation, or in clearing the opening through which the load is being dumped. Guide and stop mechanisms have been provided which guide the direction of movement of the elevator forward and rearward and which prevent the elevator from being lowered beyond a predetermined level.

The prior devices made only limited provision for limiting the potential upward swing of the elevator relative to the blade. The result has been that the flights or bars on the elevator have been swung forward far enough to strike and gouge the spreader tube supporting the bowl on the tractor. Damage to the spreader tube or to the flights on the elevator can disable or reduce the effectiveness of the vehicle.

SUMMARY OF THE INVENTION

The present invention is directed to overcoming one or more of the problems set forth above.

According to the present invention, motionlimiting apparatus is provided between the carriage of the elevator and the side walls of the scraper bowl which, not only limits the downward movement of the elevator, but also limits the upward movement of the elevator so as to prevent the flights or lifting tracks on the elevator from contacting the spreader tube. The elevator is still free to swing forwardly and upwardly about a fixed pivot so as to accommodate for obstructions, such as large rocks or boulders.

The elevator is pivotally mounted about a fixed pivot on the inside of the scraper bowl so that the elevator has a somewhat translatory and circulatory motion about the pivot whereby the elevator swings forward and upward relative to the blade on the bowl. A movable stop is mounted on the elevator and extends between a pair of fixed stops carried by the side walls of the scraper bowl such that as the elevator is moved about the fixed pivot, the movable stop will travel between the fixed stops on the scraper bowl to limit, not only the downward extent of movement of the elevator, but also the upward limit of movement. The fixed stops are of such a construction and are located in such a way that shock loads at the extremes of movement of the elevator are cushioned and the elevator cannot swing to an extent that would cause it to interfere with the spreader tube or other parts of the vehicle.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 3 is an enlarged broken away view of the upper corner of the scraper bowl showing the movable stop and the fixed stops of our invention;

FIG. 4 is a perspective view of the parts shown in FIG. 3;

FIG. 5 is a cross-sectional view taken along the line 5—5 of FIG. 3;

DESCRIPTION OF THE PREFERRED EMBODIMENT

Figure 1:
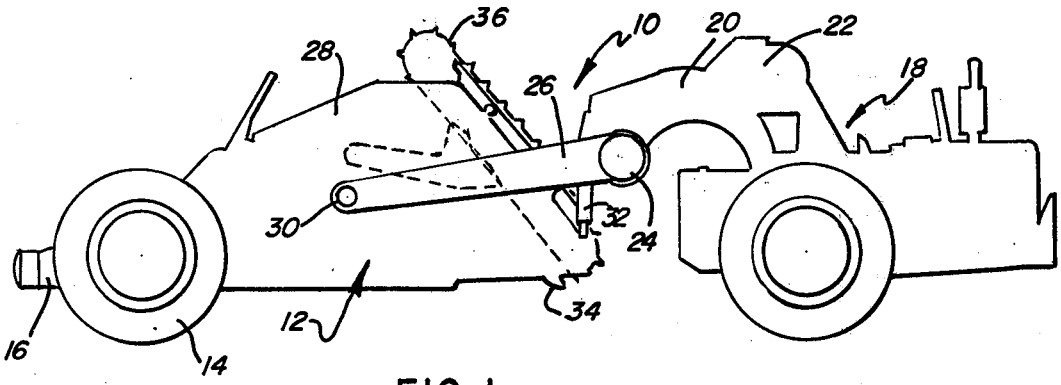
FIG. 1 is an elevational view of a tractor scraper shown somewhat in phantom with the elevator incorporating our invention shown therein.

Referring to the drawings, and, in particular, to FIG. 1, a tractor scraper 10 is illustrated and includes a bowl assembly 12 mounted on a pair of wheels 14 by a frame 16. The bowl 12 is drawn by a tractor 18 connected through a gooseneck 20 and swivel hitch 22 to a transverse spreader tube 24 which support the forward ends of the draft arms 26. The rear portions of the draft arms 26 are connected to the midportions of the walls 28 of the bowl 12 at pivots 30. Hydraulic jacks 32 are connected between the spreader tube 24 and the forward corners of the bowl 12 and are used to raise and lower the front of the scraper bowl 12 about the axis of the wheels 14 so as to bring the cutting blade 34, carried by the forward edge of the bowl 12, into contact with the soil surface. An elevator 36 is pivotally mounted on the walls 28 of the scraper bowl 12 and is held in a position with respect to the cutting blade 34 as to assist in moving the soil, cut loose by the blade 34, upwardly and into the bowl. The elevator 36 acts as the forward wall of the scraper bowl 12. Well-known structures are provided for opening and closing the bottom of the bowl 12 for ejecting the load of soil in the bowl.

Figure 2:
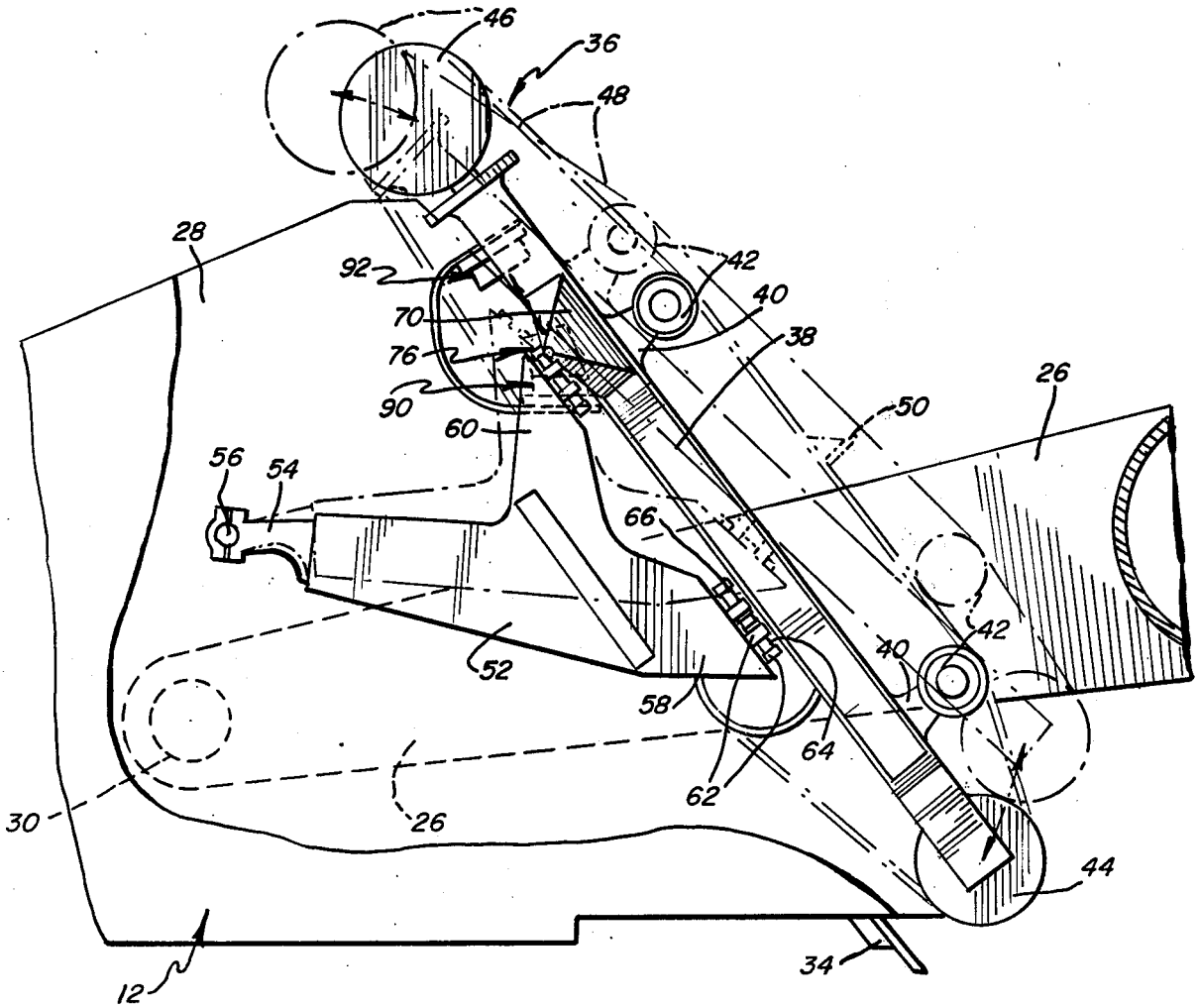
FIG. 2 is an enlarged elevational view of the elevator of FIG. 1 showing our invention.

Referring to FIGS. 2 through 5 and, in particular, at the outset to FIG. 2, the elevator 36 is of a fairly standard construction and is comprised of a carriage or frame 38 extending the length and width of the elevator. Lugs 40 extend up from the two side rails of the frame 38 to support idler rollers 42. The lower end of the carriage or frame 38 has a pair of brackets for supporting the spaced idler rollers 44. The upper end of the frame 38 supports a pair of sprockets 46 each one of which lines up with the idler rollers 42 and idler roller 44 on that side of the frame. A pair of endless chains 48 encircle the sprockets 46, idlers 44 and idlers 42 with one chain on each side of the frame 38. A plurality of spaced apart flights or bars 50 are attached between the chains 48, which flights are used to convey the soil from the surface into the bowl. To drive the elevator 36, a hydraulic motor, not shown, is coupled to the upper sprocket gears 46.

To provide the elevator 36 with a floating action, a linkage assembly 52 is mounted on each side of the elevator with each linkage 52 being pivotally connected at one end portion 54 to a pivot 56 carried by the wall 28 of the bowl 12. The linkage assembly 52 has one leg 58 aligned with the end portion 54 and has a second leg 60 projecting outwardly from the axis between portion 54 and leg 58. The legs 58,60 have transversely disposed eyelets 62 extending outwardly therefrom. All of the eyelets 62 on the leg 58 align with the eyelets 62 on the leg 60. An axis through the aligned eyelets 62 on legs 58 and 60 forms an acute angle with the axis between portion 54 and leg 58 which last-named axis passes through the pivot 56. The eyelets 62 on the legs 58 and 60 interleaf with mating eyelets 64 carried by the under portion of the carriage or frame 38 so that pivot pins 66 passing through the interleafed eyelets 62,64 provide a pivot axis between the linkage assembly 52 and the carriage or frame 38. The pivots between the linkage assembly 52 and the carriage 38 permit some limited sideward movement of the elevator 36 relative to the bowl 12.

The geometry of the connection between the linkage assembly 52, the bowl 12, and the elevator 36 is such that the elevator 36 will pivot about the axis of the pivot 56 and, because of the angular relationship between the axis from the pivot 56 through the leg 58 and the axis of the pivots 66 between the linkage 52 and the carriage 38, the idler 44 at the lower portion of the elevator 36 will move upwardly and slightly forwardly with respect to the cutter blade 34 on the bowl. The sprockets 46 on the upper portion of the elevator 36 will move rearwardly and slightly upwardly with respect to the bowl 12 so as to provide maximum clearance between the idler roller 44 and the cutter blade 34 of the bowl to permit an obstruction to clear the passage into the bowl.

In viewing FIGS. 2 through 5, inclusive, the frame or carriage 38 of the elevator 36 has laterally outwardly extending brackets 70 on each side thereof. The outer end of each bracket 70 has a sleeve 72 in which is seated one end of an outwardly extending pin 74. The pin 74 projects into a stop block 76 which is held assembled with the pin 74 by means of the circular plate 78 secured to the outer end of the pin 74. It should be noted that the pin 74 is keyed in the sleeve 72 by the key 80 and the stop block 76 is limited in movement about the axis of the pin 74 by means of a block member 81 secured to the side of the stop 76 which has one side mating with a flat 82 on the plate 78. The stop 76 is a four-sided member with oppositely facing contact surfaces lying in planes forming an acute angle with respect to each other. The stop 76 is moved upwardly and rearwardly with the carriage 38 and elevator 36.

The side walls 28 of the bowl 12 are shown in FIGS. 4 and 5 as comprised of a pair of spaced apart plates 84,85 with the outer plates having a short arcuate-shaped slot 86 cut therethrough. In FIG. 3, the slot 86 is shown in phantom since the plate 84 is broken away to illustrate the stops. The inner plate 85 has a cutout 87, somewhat triangular in configuration, with a platform 88 extending transverse to and between the outer and inner plates 84,85, respectively. The platform 88 is formed in a C-shape to form a cavity from the inside of the bowl into each wall of the bowl. Fixed, spaced apart resilient stops 90,92 are mounted on the bottom and top portions of the platform 88. The stops 90 and 92 are each comprised of a block 96 of rubber or other resilient material to which a contact plate 98 is bonded or otherwise secured. The stops 90 and 92 are mounted on the platform 88 with shims 94 between the stops and the platform. An appropriate number of shims 94 is selected to locate the surfaces of the plates 98 in the proper position to limit upward and downward movement of the elevator to the predetermined level. The resilient stop 90 is secured to the flat bottom portion of the platform 88 in the side walls. The comparable resilient stop 92 is mounted to the top portion of the C-shaped platform 88, such that the center of the contact plate 98 of stop 90 falls on the same arcuate path as the center of the other contact plate 98 of the other stop 92 with an arc between the centers of said contact plates 98 coinciding with the arcuate path of movement of the center of the pivot pin 72 and stop 76 projecting outwardly from the frame or carriage 38 of the elevator 36.

The arcuate slot 86 in the plate 84 of the wall 28 of the bowl aligns with the circular plate 78 on the pin 74 throughout the arc of travel of the pin 74 and plate 78. The slot 86 is used to assemble the elevator 36 to the bowl. That is, the elevator 36 is held by a crane, or the like, generally in position on the bowl, the movable stop 76 is placed on the fixed stop 90 whereupon the pin 74 with the plate assembled thereon is threaded through the slot 86, through the stop 76 and into the opening in the sleeve 72 whereupon the key 80 is inserted. The same operation is performed on both sides such that when the elevator 36 is released by the crane, it is supported by the movable stops 76 on the fixed stops 90.

During use of the scraper 10, the bowl 12 is pivoted down so that the cutting blade 34 engages with and cuts a slice of soil from the surface. The elevator 36 is operating to assist in transporting the loosened soil into the bowl 12. As the blade 34 and elevator 36 engage soils of different hardness and, in particular, if they engage a large boulder, or the like, the elevator 36 will be forced forwardly and upwardly about the pivot 56 which will move the movable laterally extending stop 76 upwardly out of contact with the fixed stop 90 heading in the direction of the other fixed stop 92. If the obstruction is big enough, or the upward thrust of the elevator 36 strong enough, the laterally extending stop 76 will engage with the upper fixed resilient stop 92 thereby arresting further upward movement of the elevator 36. When the obstruction has passed, the elevator 36 will again pivot about the axis 56 to a down position with the stop 76 engaging the down-stop 90 which will properly position the idler roller end 44 of the elevator 36 with respect to the cutting blade 34. The movable stop 76, the fixed down-stop 90 and the fixed up-stop 92, together with the translatory movement of the elevator 36 about the axis 56 are designed in such a way that at no time will the flights 50, carried by the chains 48 of the elevator 36, be raised enough to engage with the spreader tube 24. In this way, damage to the spreader tube or to the flights 50 will be avoided.

Figure 6:
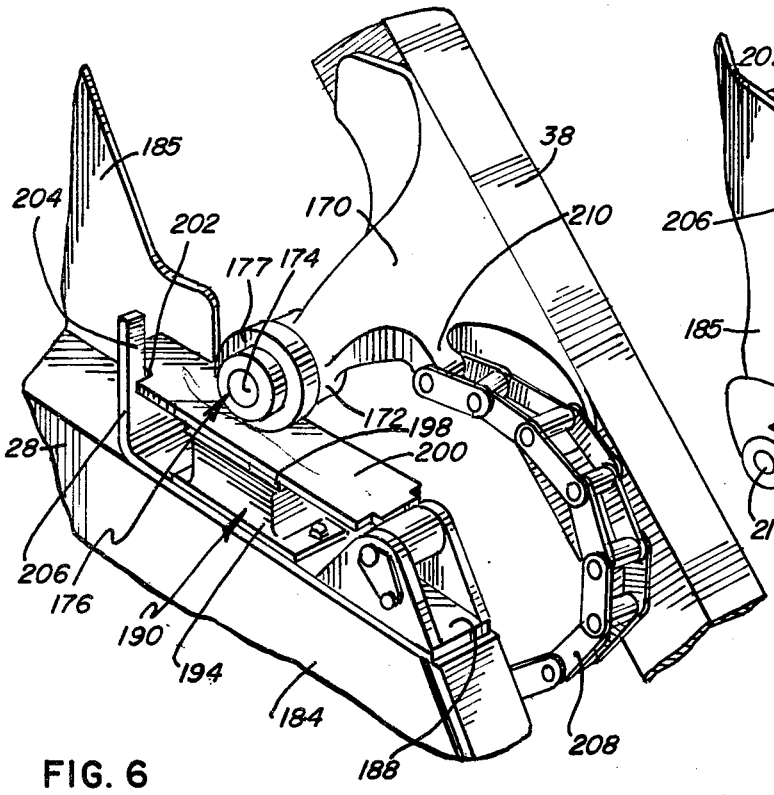
FIG. 6 is a perspective view of one modified version of our invention.
Figure 7:
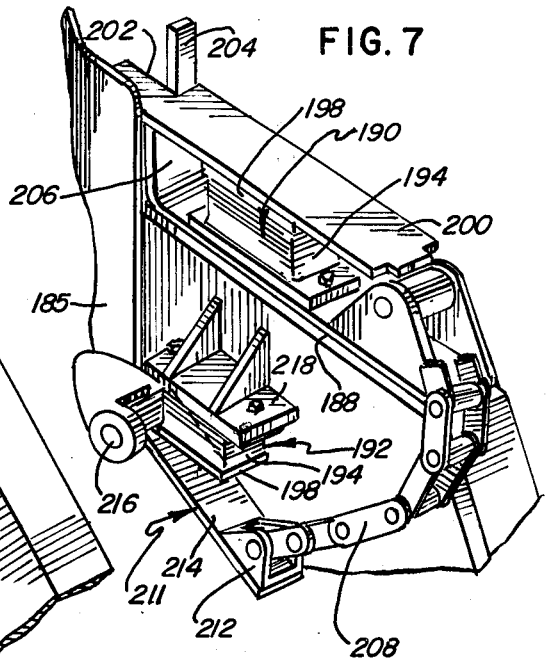
FIG. 7 is a perspective view of the modified form of invention shown in FIG. 6 only viewed as mounted on the opposite wall inside the scraper bowl.

Referring to the modification shown in FIGS. 6 and 7, it is assumed that a viewer is looking at a perspective angle toward the bowl from the tractor end of the vehicle so that FIG. 6 is the left outside wall of the bowl and FIG. 7 is the right inside wall of the bowl. The brackets 170 on the frame or carriage 38 of the elevator 36 have movable stops 176 in the form of rollers 177 carried by pins 174 supported in sleeves 172 on the brackets 170. Although only one bracket 170 and one movable stop 176 is shown, it is to be understood that a like bracket 170 and stop 176 project to the right and contact the fixed stop of FIG. 7.

A fixed resilient stop 190 is mounted on the platform 188 between the side plates 184,185 of each wall of the bowl, which stop consists of a block 194 of rubber or the like having a contact plate 198 secured to the top surface and a mounting plate 199 secured to the bottom surface thereof. The mounting plate 199 is bolted to the platform 188 in alignment with the movable stop 176. A second elongate contact plate 200 is secured to plate 198 and has a cutout 202 on one end portion which interfits with a tang 204 on an upstanding guide 206 affixed to the platform 188 for vertically guiding the plate 200. Each side of the elevator has a length of box link chain 208 with one end portion pivotally connected to a lug 210 formed on the bracket 170. The other end of each link chain 208, as can best be seen in FIG. 7, has a second movable stop 211 which comprises the chain 208 being connected to a bifurcated bracket 212 carried on the outer end of a stop plate 214 pivotally connected by a pin 216 to the inside plate 185 of each wall of the bowl on the inside of the bowl. A fixed resilient stop 192 is mounted on a bracket 218 secured to each inner wall of the bowl with the block 194 of resilient material and the contact plate 198 projecting downwardly in facing relation to the movable stop plate 214 pivotally carried by the wall. As can be seen, the frame 38 of the elevator 36 is supported by its own weight by means of movable stops 176 engaging the fixed stops 190. When the elevator 36 is forced upwardly, the stops 176 will separate from the contact plate 200 on the fixed stops 190 and the link chain 208 will begin to straighten out. If the upward movement of the frame 38 is sufficient, the chains 208 will be pulled upwardly enough to pivot the plates 214 carried by the lower portion of the chain upwardly to engage with the fixed up-stops 192 carried by the inner walls of the bowl. In this way, the upper movement of the elevator is limited by the up-stops 192. The elevator 36 is mounted for translatory movement by means of the linkage assembly 52 as described with respect to FIGS. 2 through 5. The length of the chains 208 limit the upward travel of the elevator 36 so as to prevent contact by the flights 50 on the elevator with the spreader tube 24.

Figure 8:
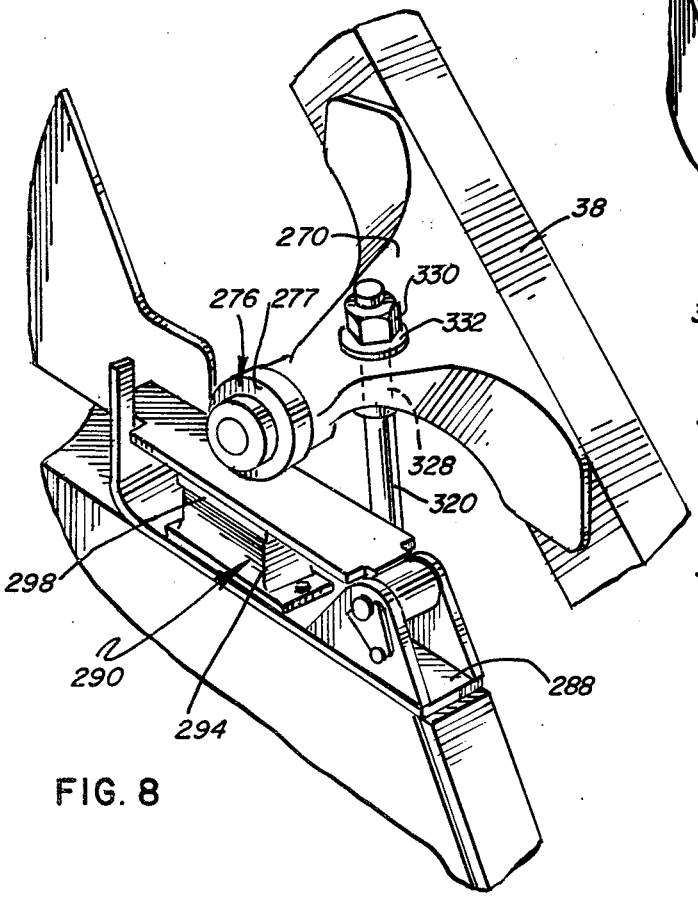
FIG. 8 is a perspective view of a further modified form of our invention.
Figure 9:
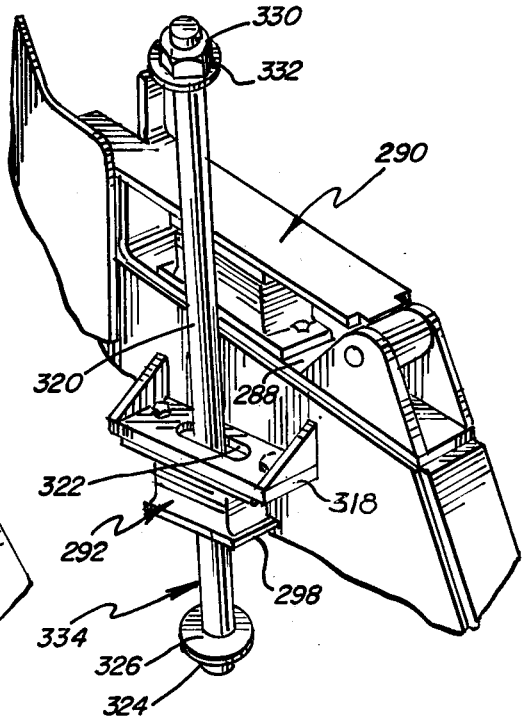
FIG. 9 is a perspective view of the modified form of our invention shown in FIG. 8 only viewed as mounted on the opposite wall inside the scraper bowl.

FIGS. 8 and 9 show still another modified version of our invention and is illustrated in the same manner as FIGS. 6 and 7, that is, FIG. 8 is the left wall of the bowl, and FIG. 9 is the right inside wall of the bowl. A bracket 270 carried by each side of the frame or carriage 38 supports movable stops 276 having rollers 277 in contact with fixed resilient stops 290 carried by platforms 288 on the side walls of the bowl. As can be seen in FIG. 9, fixed up-stop 292 is mounted on a bracket 318 on the inside of the wall of the bowl with the resiliently supported contact plate 298 facing downwardly with respect to the inside of the bowl. A comparable fixed up-stop 292 is mounted on the inside of the left-hand wall of the bowl. The stops 290 and 292 are constructed the same as stops 90,92 and 190,192. A rod 320 passes through an elongate slot 322 formed through the fixed resilient up-stop 292 with a nut 324 and washer 326 threaded on the lower portion of the rod 320. The upper portion of the rod 320 passes through an opening 328 in the brackets 270 on the frame 38 of the elevator 36 which rod 320 has a nut 330 and washer 332 affixed on the upper end thereof above the bracket 270. The lower portion of the rods 320 are free to move up and down relative to the fixed up-stops 292 so that the rods 320 and nuts 324 form second movable stops 334.

in use, as the frame of the elevator is pivoted upwardly and rearwardly about the linkage assembly 52, the movable stops 276 will be raised from the fixed resilient down-sop 290 and the rods 320 will be pulled upwardly through the fixed up-stops 292. When the elevator has moved the maximum amount, the movable stops 334 consisting of the nuts 324 on the rods 320 will contact the contact plates 298 of the fixed up-stops 292 to limit further upward movement of the elevator.

From the above, it can be seen that we have provided improvements on the elevator of a scraper, whereby the upward and downward limit of movement of the elevator relative to the bowl of the scraper is maintained. The various forms of up and down-stop mechanisms make it possible for the elevator to safely float relative to the bowl of the scraper but limit the extent of the float so as to prevent contact of the flights of the elevator with the spreader tube or other parts of the scraper mechanism.

The embodiment of the invention in which an exclusive property or privilege is claimed is defined as follows:

1. In a self-loading scraper having a bowl with a cutting blade at the forward end thereof, an elevator having a frame, a linkage assembly carried by said frame and being pivotally mounted about a fixed pivot on the inside of said bowl for positioning the lower portion of the elevator relative to said blade, said linkage assembly being such that the lower portion of the elevator will move upwardly and forwardly relative to said blade and the upper portion of the elevator will move upwardly and rearwardly relative to said bowl, laterally projecting stop means carried by an upper intermediate portion of the frame of said elevator, and vertically spaced apart, fixed stop means carried by said bowl, said laterally projecting stop means moving between said vertically spaced, fixed stop means for limiting upward and downward movement of said elevator relative to said bowl, said laterally projecting stop means is carried by a bracket on the frame of the elevator and comprises a block having planar contact faces for contacting a stop plate on each of said fixed stop means.

2. In a scraper as claimed in claim 1 wherein each said fixed stop means comprises a block of resilient material resiliently supporting said stop plate, which stop plate has a planar surface in alignment with one of the planar contact faces of the block of the movable stop means.

3. In a self-loading scraper having a bowl with a cutting blade at the forward end thereof, an elevator having a frame, a linkage assembly carried by said frame and being pivotally mounted about a fixed pivot on the inside of said bowl for positioning the lower portion of the elevator relative to said blade, said linkage assembly being such that the lower portion of the elevator will move upwardly and forwardly relative to said blade and the upper portion of the elevator will move upwardly and rearwardly relative to said bowl, laterally projecting stop means carried by an upper intermediate portion of the frame of said elevator, and vertically spaced apart, fixed stop means carried by said bowl, said laterally projecting stop means moving between said vertically spaced, fixed stop means for limiting upward and downward movement of said elevator relative to said bowl, said spaced apart, fixed stop means comprises two fixed stops on each side of said bowl, one of said fixed stops being mounted on the bowl and having means for resiliently supporting an upwardly facing planar contact surface, the second of said fixed stops being mounted on the bowl in spaced relationship with respect to said one of said fixed stops, whereby said movable stop means moves between said fixed stops for limiting upward and downward movement of the elevator, said movable stop means is a block carried by the frame and being positioned to rest on the one of said fixed stops for the downward limit of movement and being positioned to move upwardly into contact with the second of said fixed stops for the upward limit of movement of said elevator.

* * * * *